United States Patent [19]

Beleckis

[11] Patent Number: 4,981,386

[45] Date of Patent: Jan. 1, 1991

[54] NOTEBOOK WITH INTERNAL EASEL STAND

[75] Inventor: Vytautis K. Beleckis, East Longmeadow, Mass.

[73] Assignee: Dennison Manufacturing Company, Framingham, Mass.

[21] Appl. No.: 417,192

[22] Filed: Oct. 4, 1989

[51] Int. Cl.[5] ..... B42F 13/00

[52] U.S. Cl. ..... 402/73; 281/33; 402/70

[58] Field of Search ..... 281/33, 51; 402/73, 402/74, 75, 76, 77, 80 R, 80 L, 502

[56] References Cited

U.S. PATENT DOCUMENTS

| | | | |
|---|---|---|---|
| 1,292,720 | 1/1919 | Dawson | 402/73 |
| 1,577,697 | 3/1926 | Douglas | 402/73 |
| 1,979,814 | 11/1934 | Unger | 402/73 |
| 2,722,434 | 11/1955 | Wolfe | 402/73 |
| 3,450,420 | 6/1969 | Smith | 281/33 |
| 3,638,967 | 2/1972 | Mullins | 281/33 |
| 3,724,876 | 4/1973 | Krikorian | 281/33 |
| 4,213,520 | 7/1980 | Sarna | 281/33 |
| 4,576,497 | 3/1986 | Beleckis | 402/73 |
| 4,603,995 | 10/1986 | Vilona | 402/73 |
| 4,880,327 | 11/1989 | Sanabria | 402/73 |

*Primary Examiner*—Douglas D. Watts
*Assistant Examiner*—Thomas Hamill, Jr.
*Attorney, Agent, or Firm*—Barry D. Josephs

[57] ABSTRACT

A notebook having an internal easel stand. The notebook can be a looseleaf notebook. The notebook can be converted to an easel stand holding the sheets of paper in an upright position. The notebook has a flat easel panel attached to a portion of the inside surface of the notebook cover. When the notebook cover to which the easel panel is attached is flexed along a bendline running across the cover, the easel panel juts into the interior of the notebook. The easel panel is held in place in an upright position by a gripping device attached to inside surface of the cover.

13 Claims, 5 Drawing Sheets

10

13
50
40
60
72
70
65a
73
55
30a
29
25
28
52
5
5a
5b
5b-1
65b
20
5b-2
15
23
16

NOTEBOOK WITH INTERNAL EASEL STAND

BACKGROUND OF THE INVENTION

1. Field of the Invention

The present invention relates to notebooks or folders having an internal easel stand fixed to the inside cover. The invention particularly relates to looseleaf notebooks having an easel stand affixed to an inside surface of a notebook cover and forming a portion of the cover.

2. Description of the Prior Art

Looseleaf notebooks with ring binder mechanisms to hold looseleaf paper are well known in the art. Such notebooks are in common use by students, sales persons, business and technical personnel and in general all in widespread use. Looseleaf notebooks are often available with built in pockets for holding various items such as pens, pencils or notepaper. Looseleaf notebooks may typically include a clip affixed to one end of the inside cover normally at the top end so that the user can conveniently secure unbound documents or notes of particular interest.

Conventional looseleaf notebooks or other notebooks for holding or filing papers normally are not intended for use in displaying the stored contents to others. Such notebooks also can not be conveniently used for the writing of text contained in any of the sheets found therein when the notebook is held in an upright position. There is a need by many users, particularly sales people, to be able to display any one or more of the sheets contained in the notebook without removing the sheets from the book. There is also a need by many users to be able to fold the notebook in an upright position while hand writing information on any of the sheets contained therein. U.S. Pat. No. 3,724,876 discloses a looseleaf notebook binder which is convertible into an easel stand. The convertible notebook disclosed in this reference has two fastener bails or hooks affixed to the inside surface of one side of the notebook cover. When it is desired to convert the notebook to an easel stand, the looseleaf binder rings are opened and the cover containing the fastener hooks is partially closed to permit engagement of the hooks onto the binder rings. The opposite side of the cover, that is, the side not containing the fastener hooks, is foldable under the rings resulting in a standing base. When this is done, the cover containing the hooks forms an easel stand which is kept from falling over by the standing base and the hooks now pulling on the binder rings. The easel stand formed in this manner allows for display of any one of the looseleaf sheets contained in the notebook. But it has the disadvantage that the easel is not supported securely enough at its base to allow for writing on the looseleaf sheets without causing the easel to topple backward.

Accordingly, it is an object of the present invention to provide a notebook, particularly a looseleaf binder notebook, which can be readily converted into an easel stand for display of any one of the looseleaf sheets contained therein.

It is an important object to provide a notebook convertible to an easel secure enough when opened to an upright position to permit hand writing or sketching on any of the looseleaf sheets on the easel.

Another objective of the invention is to include a line guide which is slidable along the edges of the looseleaf sheet when the easel stand is open and the looseleaf sheets appear in an upright position.

SUMMARY OF THE INVENTION

The notebook with internal easel is preferably composed of a looseleaf binder cover with a conventional looseleaf ring binder mechanism located inside the cover for securing looseleaf sheets within the notebook. The cover is formed of a rigid material such as rigid cardboard or plastic, and is typically overlaid with fabric or plastic film to provide an attractive appearance. The cover folder is foldable along its mid length forming front and back and enable the notebook to open and close. Additionally, one of either the front or back panels has an easel bendline running transversely across the width of the panel. A flat rigid panel is secured to the inside surface of the cover panel having the easel bendline, so that an easel is formed when the notebook cover is bent alone the easel bendline.

The ring binder mechanism is preferably affixed to a rigid support panel jutting out from either the lower portion or the upper portion of the easel panel. When the looseleaf notebook is opened and the easel panel pulled out, the easel panel is held securely by engagement of a gripping device located on the underside of the support panel and on the inside of the notebook cover.

The notebook of the invention is thus easily converted to a stand up easel for display of the sheets of paper contained in the notebook. The easel support mechanism is secure enough to permit writing onto the sheets of paper held by the easel in an open upright position. Optionally a line guide may be slidably mounted onto the exposed sheet of paper in upright position on the easel. The line guide functions as a display aid or as an aid for typing text from the looseleaf sheets.

The present invention can also be employed with rigid notebooks that do not contain looseleaf ring binders.

DETAILED DESCRIPTION

Figure 1:
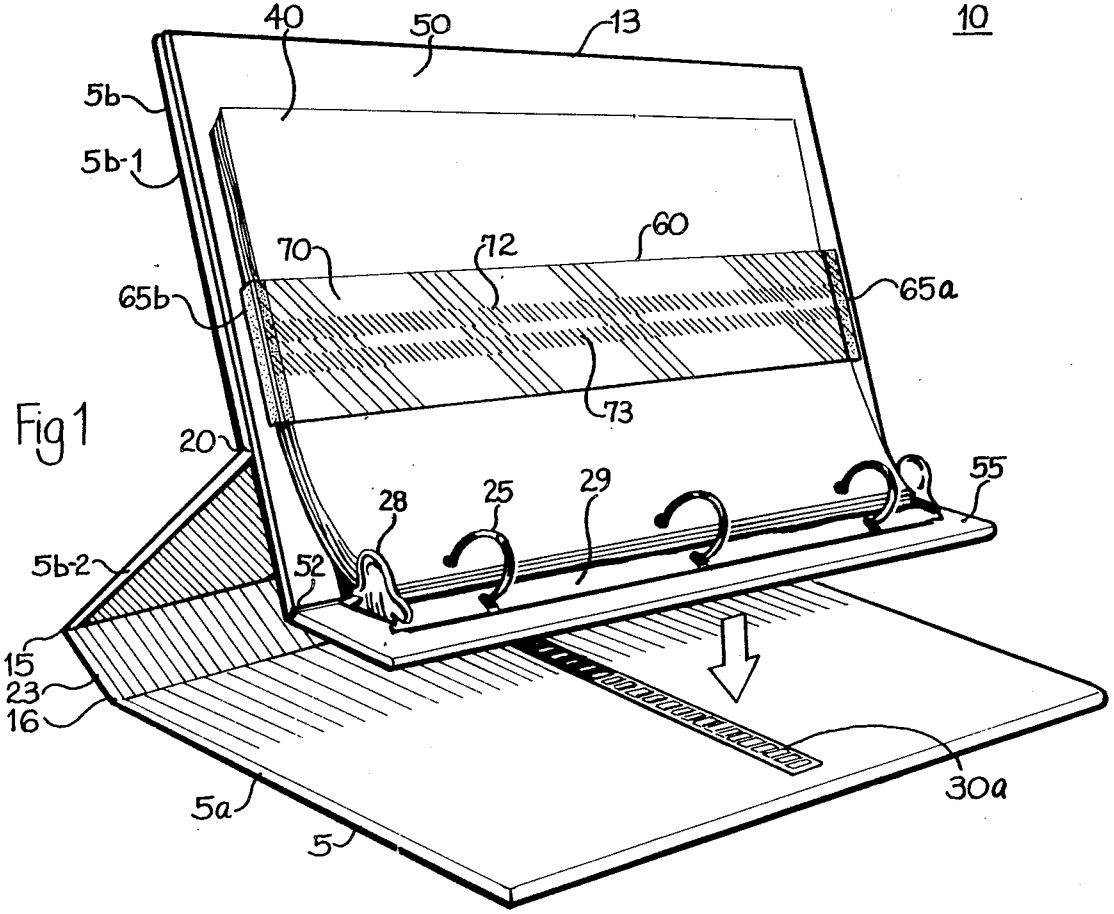
FIG. 1 is a perspective view of a preferred embodiment of the loose-leaf notebook of the present invention being converted into an easel stand.

A preferred embodiment of the convertible looseleaf notebook 10 as illustrated in FIG. 1 is composed of a rigid notebook cover 5 having parallel bendlines (hinges) 15 and 16 running transversely across the width of the notebook cover 5. Bendlines 15 and 16 are typically centrally disposed midway along the length of cover 5 and are typically spaced apart about 2 to 2 ½ inches. (Depending on ring mechanism capacity, they may be 1" to 3 ½" apart). Bendlines 15 and 16 divide the cover panel 5 into first and second ridge panels **5*a* and 5*b*, each affixed to a binder panel 23 positioned between bendlines 15 and 16. Rigid panel 5*b* contains a bendline 20 running transversely across its width. Bendline 20** runs parallel to bendlines 15 and 16 and is located at a point between bendline 15 and the outer edge 13 of panel 5b. Preferably bendline 20 is located about ¼ to ½ the distance from bendline 15 to outer edge 13 of panel 5b as measured from line 15. Rigid panel 5b thus can be bent or folded along bendline 20, thus dividing panel 5b into upper and lower panels, 5b-1 and 5b-2, respectively. A flat rigid panel 50 is affixed to the inside surface of upper panel 5b-1 and extends in length to bendline 15 when panel 5b is in a flat position. That is, panel 50 is preferably the same or nearly the same length as panel 5b so that the lower edge 52 of panel 50 comes into contact or alignment with bendline 15 when panel 5b is in a flat position as illustrated best in FIG. 3. Thus when notebook 10 is opened and panel 5b is bent inward along easel bendline 20, easel panel 50 juts out into the interior portion of the notebook forming an easel backing for sheets 40 held within the notebook.

A rigid ring binder mechanism support panel 55 as shown in FIG. 1 may be secured to edge 52 of easel panel 50 so that panel 55 extends from easel panel 50 along edge 52. Additionally, support panel 55 is connected to panel 50 along edge 52 so that it can bend or flex along edge 52. Support panel 55 has connected thereto a conventional, ring binder mechanism typically containing three looseleaf rings 25 with conventional booster 28 which the user may operate to open or close rings 25. When rings 25 are open, looseleaf papers 40 may be removed or inserted in a conventional manner, whereupon rings 25 can again be closed. Rings 25 are actuated by a conventional spring mechanism (not shown) held within cover plate housing 29. Accordingly notebook 10 may be employed in conventional manner as in any looseleaf notebook and has the additional feature that it is convertible into an easel stand for the looseleaf papers 40 therein.

Figure 1A:
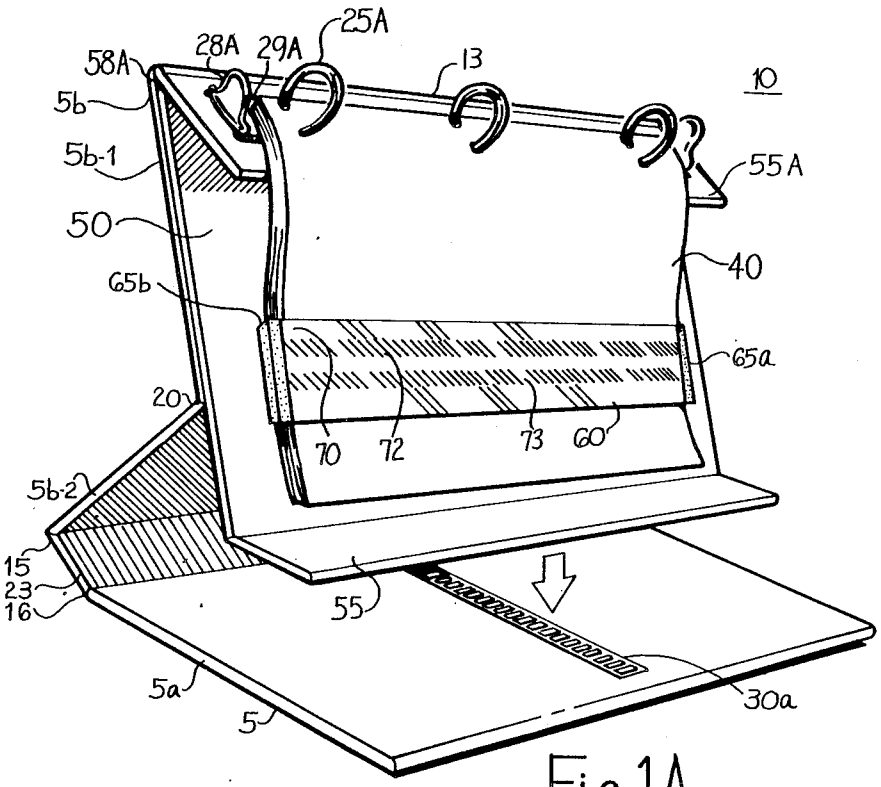
FIG. 1A is a perspective view of an alternative embodiment of the looseleaf notebook of the present invention being converted into an easel stand.

In an alternative embodiment shown in FIG. 1A, rings 25A and associated housing 29A which are mounted on panel 55A are located on the upper edge 13 of upper panel 5b-1 or alternatively to the upper edge of easel panel 50. In this embodiment panel 55 does not contain a ring mechanism. Except for this displacement of the rings to the upper edge 13 of panel 5b-1, or else to the upper edge of easel panel 50, the notebook 10 of FIG. 1A has the same features as the embodiment shown in FIG. 1 and is convertible to an easel stand in the same manner. The panel 55A is preferably affixed along one edge 58A thereof to upper edge 13 of panel 5b-1. This allows panel 55A to be flappable along the edge 13 to which it is adjoined. When the notebook is in the easel position, looseleaf sheets can be turned over edge 13 thus displaying new sheets.

Figure 2:
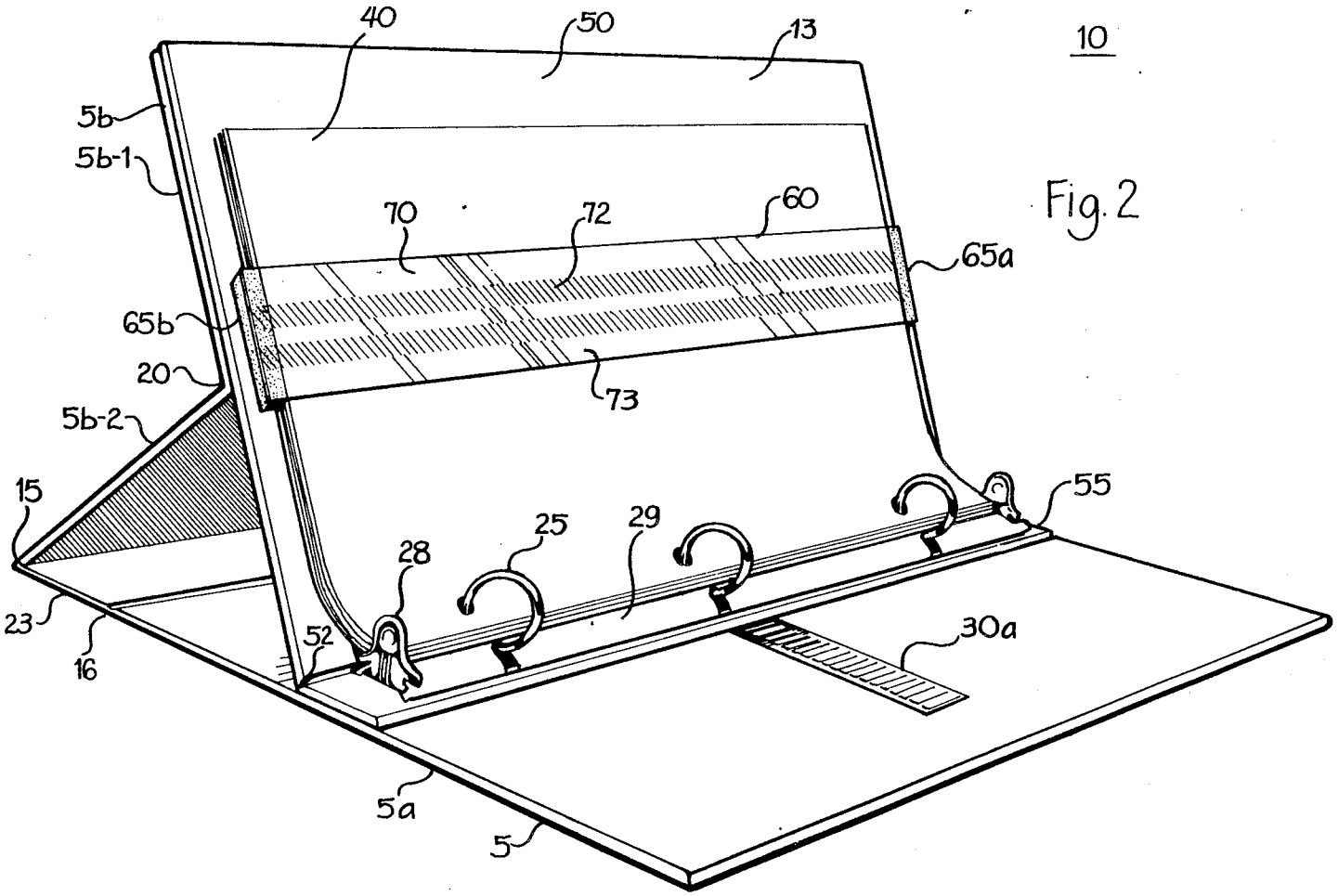
FIG. 2 is a perspective view of the looseleaf notebook of FIG. 1 converted into an easel, with the easel firmly secured in an upright position.
Figure 3:
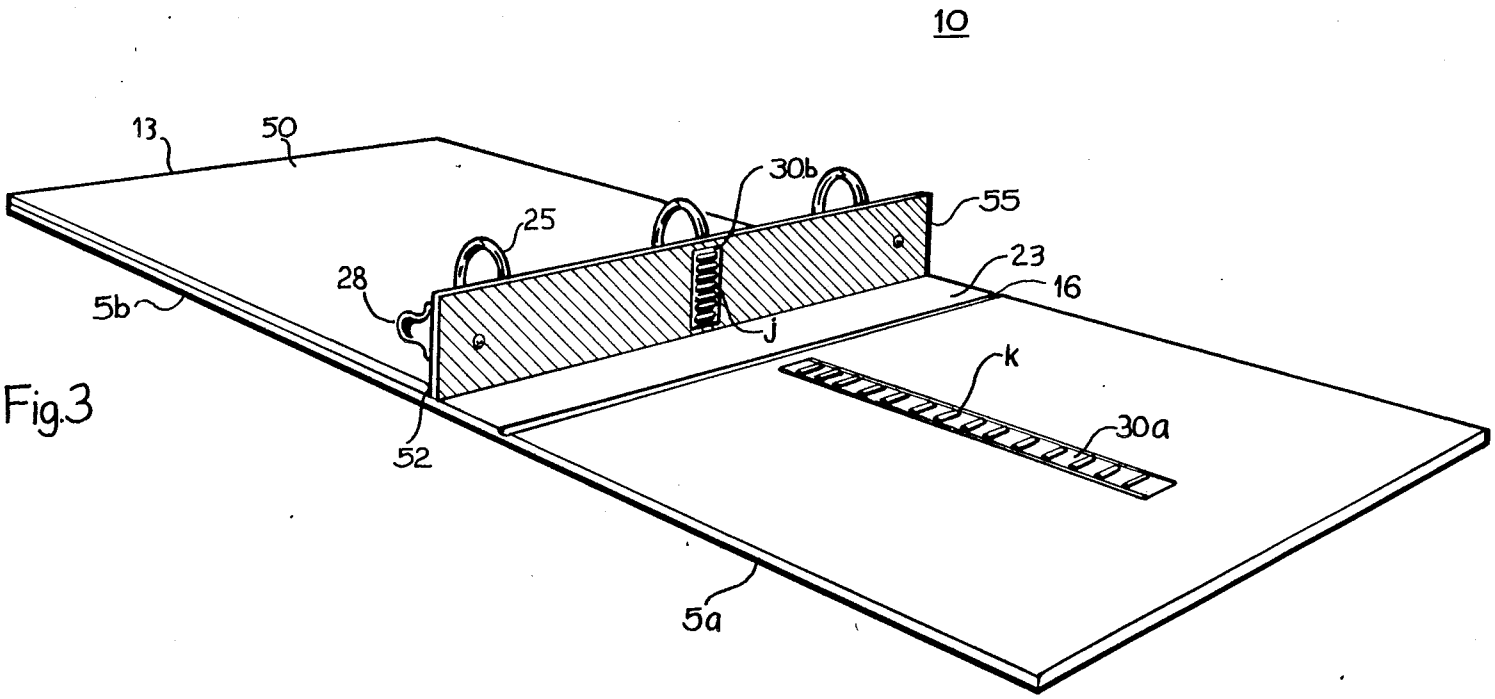
FIG. 3 is a perspective view of the notebook shown in FIGS. 1 and 2 wherein the notebook is opened to a flat position.
Figure 4:
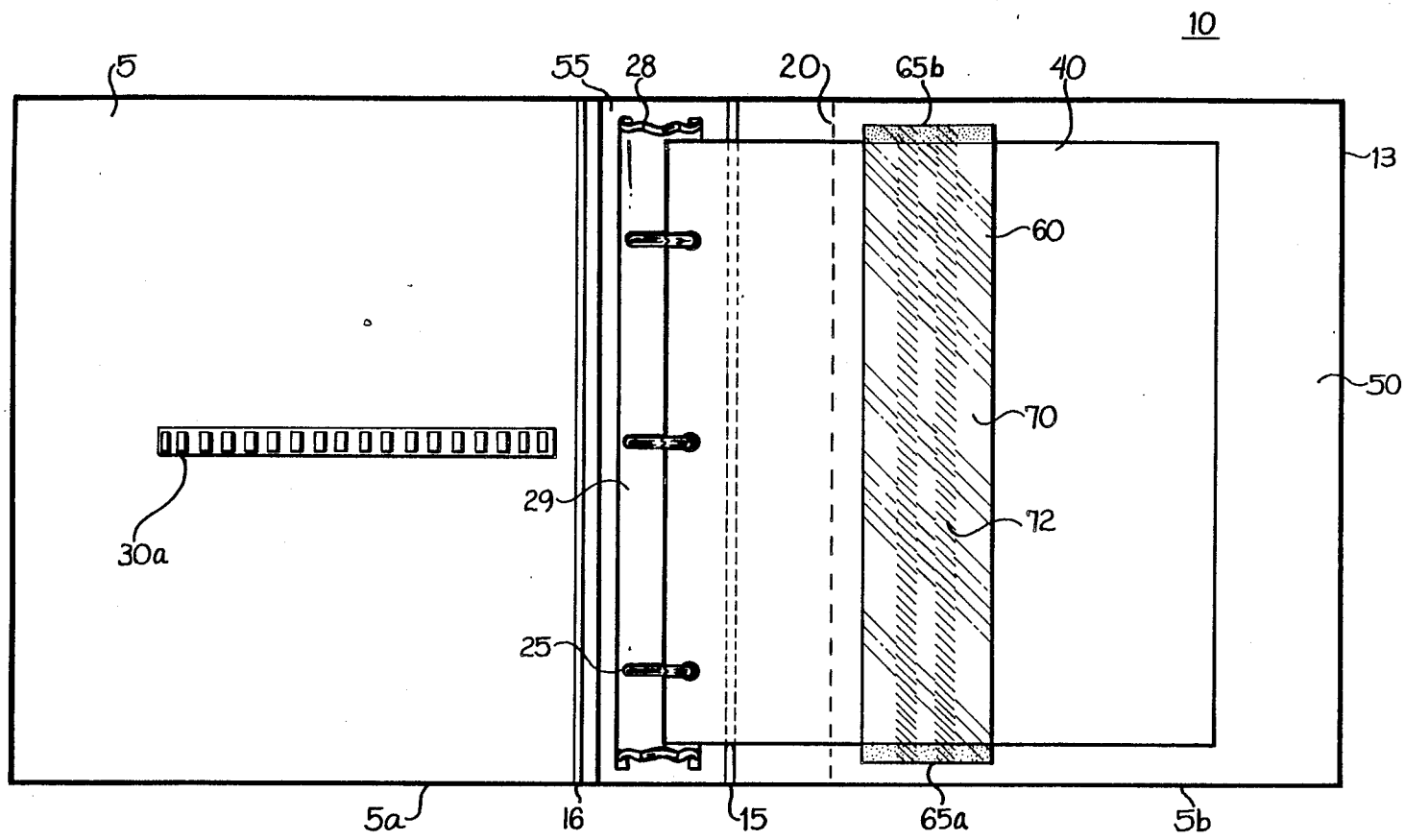
FIG. 4 is a plan view of the looseleaf notebook of FIG. 1 in an open flat position.

In operation, when it is desired to convert looseleaf notebook 10 of FIG. 1 to an easel stand, the notebook is opened and panel 5b is simply flexed along line 20 so that upper panel 5b-1 juts inwardly along bendline 20, causing easel panel 50 to jut out into the interior space of notebook 10 as illustrated in FIG. 1. Easel panel 50 is then moved downwardly until the bottom surface of ring binder support panel 55 comes to rest against the inside surface of cover panel 5a as shown best in FIGS. 1 and 2. Support panel 55 is held securely to the inside surface of cover panel 5a by a fastening or gripping mechanism 30. Fastening mechanism 30 may be selected from a variety of devices, but applicant has found the use of a pair of serrated locking strips 30a and 30b as illustrated in FIG. 3, to provide a convenient and secure locking mechanism. Serrated strip 30a is typically made of heavy plastic or other material with locking protrusions or notches k aligned along the length of the strip. A serrated mating strip 30b is secured to the underside of ring binder support panel 55. Serrated strip 30b has protrusions or notches j which interlock with those of k in strip in 30a. The locking elements k and j may be in the form of interlocking fibrous hooks, ribs or spikes which protrude from strips 30a and 30b, respectively. One such material is available under the trademark VELCRO fastening strip's from VELCRO, Inc., Manchester, N.H.. Thus, when easel 50 is opened and mating strips 30a and 30b are pressed together, panel 50 is held firmly in place in upright position and panel 50 does not come loose or slide out even if the user writes on the looseleaf sheets 40 held thereon. Other devices may be used to hold the support panel 55 securely against the inside surface of cover panel 5a. For example, instead of using serrated strips, it is possible to use mated fastening buttons or clips. Such devices have the disadvantage, however, that the user must spend additional time in aligning the clips and buttons on the inside surface of cover 5a with their mated counterpart on the underside of support panel 55. The advantage of using the interlocking strips 30a and 30b as aforementioned is that they are instantly engagable to provide a secure firm lock between support panel 55 and cover panel 5a. Another advantage is that the angle of panel 5b-1 may be varied to almost an infinite number of positions.

The operation of the embodiment shown in FIG. 1A is essentially the same as that of FIG. 1, except that the rings 25A and associated housing 29A and mounting panel 55A are located on the upper edge 13 of upper panel 5b-1, or alternatively they may be located along the upper edge of easel panel 50. Panel 55 of embodiment FIG. 1A is located in the same position as that of FIG. 1. The notebook of FIG. 1A otherwise contains the same features and converts to an easel stand in the same manner as that described with respect to FIG. 1. Thus, FIG. 1A embodiment may also contain the same mating strips 30a and 30b of same material with interlocking fibrous hooks, ribs or spikes as described herein above, with respect to FIG. 1. In the FIG. 1A embodiment, strip 30b (not shown) is located under panel 55 and strip 30a is located on the inside of cover of panel 5a in the same position shown and described with respect to the FIG. 1 embodiment, e.g. at FIG. 3.

A transparent line guide 60 may be optionally provided as an aid in reading text from looseleaf sheets 40 held in upright position when easel panel 50 is locked in place. Line guide 60 has particular utility as a typing aid when it is necessary to type text which has to be read directly from looseleaf sheets 40. Line guide 60 is composed of a transparent plastic strip 70 having pads preferably of foamed plastic located on either end of strip 70. Line guide 60 has transparent tinted guidelines 72 and 73 running across the length of strip 70 so that text is clearly visible in the space therebetween. It has been found the line guide 60 with foamed plastic end pads 65a and 65b fitted to a clear plastic strip 70 provides a convenient guide held frictionally in place along the edges of the notebook sheets 40 as illustrated in FIGS. 1 and 2. Plastic sheet 70 may typically be of any clear plastic material and of thickness sufficient to provide a rigid strip. Although foamed plastic is preferred for end pads 65a and 65b, other materials can be chosen as long as strip 70 can be frictionally and slidably mounted onto the edges of looseleaf sheets 40.

The notebook cover 5 is made typically of rigid cardboard or plastic material which may be covered by a printed or embossed paper or plastic film to give the cover an attractive appearance. Easel panel 50 is also preferably made of rigid cardboard or plastic material to provide a rigid surface. Easel panel 50 is similarly covered with a printed plastic film or paper sheet to provide an attractive appearance. Other materials for the notebook may be employed, provided that the notebook cover and easel panel are of sufficient rigidity.

Although the present invention has been described with respect to a specific embodiment it should be appreciated that other embodiments are possible without departing from the concept and scope of the present invention. For example, the concept of the present invention could be employed with an open folder or notebook cover without the use of a ring binder mechanism. In such an embodiment, the sheets of paper are simply held loosely in place within the folder or notebook. The easel panel and securing mechanism for such an embodiment could be identical or similar to that described herein. Accordingly, the present invention is not intended to be limited by the specific embodiment but rather is defined by the claims and equivalents thereof.

What is claimed is:

1. A notebook for conversion to an easel stand at will, said notebook comprising:

a first cover panel, a binder panel and a second cover panel, said first cover panel affixed to the binder panel and the binder panel affixed to the second cover panel, said first cover panel being bendable along a bendline intermediate the binder panel and the outermost edge of the first panel and dividing said first panel into an upper portion and a lower portion, and a flat easel panel attached to the upper portion of the first panel, enabling the easel panel to protrude into the interior of the notebook when the notebook is opened and the first cover panel is bent along said bendline.

2. A notebook as in claim 1 further comprising:

means for securing the easel panel to the second cover panel when the notebook is opened and the easel panel is caused to protrude into the interior of the notebook by bending the first panel along said bendline.

3. A notebook as in claim 2 further comprising looseleaf rings, and support panel therefor, said support panel affixed to the anterior portion of the easel panel, said anterior portion jutting away from the first panel and moving towards the interior of the notebook when said notebook is opened and the first panel is bent along said bendline.

4. A notebook as in claim 2 further comprising looseleaf rings, and support panel therefor, said support panel affixed proximally to an outer edge of said first cover panel.

5. A notebook as in claim 1 wherein the first and second cover panels and easel panel are comprised of rigid material.

6. A notebook as in claim 2 wherein said means for securing the easel panel to the second cover panel comprises:

a first strip of material affixed to the inside surface of the second cover panel, said first strip having gripping protrusions running substantially along its length said protrusions on the first strip being mateable with the protrusions on a second strip attached to the easel panel so that the easel panel is held securely in place in an upright position when said second strip is pressed into contact with the first strip.

7. A notebook as in claim 6 wherein said second strip is affixed to the underside of said support panel affixed to the easel panel.

8. A notebook as in claim 6 wherein the gripping protrusions on the first and second strips are in the form of notches.

9. A notebook as in claim 2 further comprising a line guide attachable to opposite edges of sheets of paper, said sheets of paper held in place in said notebook, said line guide comprising a transparent plastic strip having friction pads attached to opposite ends thereof, said friction pads holding the transparent plastic strip in place over the sheets and permitting manual sliding of said plastic strip across the surface of the sheets in a direction perpendicular to said plastic strip.

10. A notebook as in claim 8 wherein the friction pads comprise a foamed plastic or rubber.

11. A looseleaf ring notebook for conversion to an easel stand at will, said notebook comprising:

looseleaf rings;

a first cover panel, a binder panel and a second cover panel, said first cover panel affixed to the binder panel and the binder panel affixed to the second cover panel, said first cover panel being bendable along a bendline intermediate the binder panel and the outermost edge of the first panel and dividing said first panel into an upper portion and a lower portion; and a flat easel panel attached to the upper portion of the first panel, so that the easel panel protrudes into the interior of the notebook when the notebook is opened and the first cover panel is bent along said bendline.

12. A looseleaf ring notebook as in claim 11 wherein the looseleaf ring is affixed to a support panel and said support panel affixed to the anterior portion of the easel panel, said anterior portion jutting away from the first panel and moving towards the interior of the notebook when said notebook is opened and the first panel is bent along said bend line.

13. A looseleaf ring notebook as in claim 11 wherein the looseleaf rings are affixed to a support panel and the support panel is affixed proximally to an outer edge of said first cover panel.

* * * * *